US005722384A

United States Patent [19]

Cox

[11] Patent Number: 5,722,384

[45] Date of Patent: Mar. 3, 1998

[54] MULTI-DIRECTIONAL BALL THROWING SYSTEM

[76] Inventor: Stacey L. Cox, 431 Reg Holland Rd., Vidalia, Ga. 30474

[21] Appl. No.: 720,048

[22] Filed: Sep. 27, 1996

[51] Int. Cl.[6] ..... F41B 15/00

[52] U.S. Cl. ..... 124/78; 124/81; 124/84

[58] Field of Search ..... 124/78, 34, 81, 124/83, 84

[56] References Cited

U.S. PATENT DOCUMENTS

| | | | |
|---|---|---|---|
| 3,538,900 | 11/1970 | Samuels | 124/78 |
| 3,590,524 | 7/1971 | Beny | 124/78 X |
| 3,641,704 | 2/1972 | Sims et al. | 124/78 X |
| 4,006,726 | 2/1977 | Sweeton et al. | 124/81 |
| 4,241,707 | 12/1980 | Mariani | 124/83 |
| 4,250,862 | 2/1981 | Speer | 124/83 X |
| 4,345,578 | 8/1982 | Speer | 124/83 X |
| 4,531,504 | 7/1985 | Gilreath | 124/78 |
| 4,570,607 | 2/1986 | Stokes | 124/81 X |
| 4,699,378 | 10/1987 | Sung | 124/54 |
| 5,046,476 | 9/1991 | Nozato | 124/78 |
| 5,125,653 | 6/1992 | Kovacs et al. | 124/78 |
| 5,437,261 | 8/1995 | Paulson et al. | 124/81 X |

*Primary Examiner*—Terry Lee Melius
*Assistant Examiner*—Thomas A. Beach

[57] ABSTRACT

A new Multi-Directional Ball Throwing System for propelling a ball in three selective directions at various velocities without the user discontinuing play. The inventive device includes a housing, a plurality of storage tubes secured to said housing which store a plurality of balls, a propelling means connected to the storage tubes, and a corresponding plurality of delivery tubes with an arcuate lumen which are rotatably secured to the housing and connected to the propelling means opposite of the storage tubes.

9 Claims, 3 Drawing Sheets

MULTI-DIRECTIONAL BALL THROWING SYSTEM

BACKGROUND OF THE INVENTION

1. Field of the Invention

The present invention relates to Ball Throwing Devices and more particularly pertains to a new Multi-Directional Ball Throwing System for propelling a ball in three selective directions at various velocities without the user discontinuing play.

2. Description of the Prior Art

The use of Ball Throwing Devices is known in the prior art. More specifically, Ball Throwing Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Ball Throwing Devices include U.S. Pat. No. 5,347,975; U.S. Pat. No. 4,655,190; U.S. Pat. No. 4,193,591; U.S. Pat. No. 4,563,999; U.S. Pat. No. 4,086,903; U.S. Pat. No. 4,015,578; U.S. Des. Pat. No. 278,841; and U.S. Des. Pat. No. 269,894.

While these devices fulfill their respective, particular objectives and requirements, the aforementioned patents do not disclose a new Multi-Directional Ball Throwing System. The inventive device includes a housing, a plurality of storage tubes secured to said housing which store a plurality of balls, a propelling means connected to the storage tubes, and a corresponding plurality of delivery tubes with an arcuate lumen which are rotatably secured to the housing and connected to the propelling means opposite of the storage tubes.

In these respects, the Multi-Directional Ball Throwing System according to the present invention substantially departs from the conventional concepts and designs of the prior art, and in so doing provides an apparatus primarily developed for the purpose of propelling a ball in three selective directions at various velocities without the user discontinuing play.

SUMMARY OF THE INVENTION

In view of the foregoing disadvantages inherent in the known types of Ball Throwing Devices now present in the prior art, the present invention provides a new Multi-Directional Ball Throwing System construction wherein the same can be utilized for propelling a ball in three selective directions at various velocities without the user discontinuing play.

The general purpose of the present invention, which will be described subsequently in greater detail, is to provide a new Multi-Directional Ball Throwing System apparatus and method which has many of the advantages of the Ball Throwing Devices mentioned heretofore and many novel features that result in a new Multi-Directional Ball Throwing System which is not anticipated, rendered obvious, suggested, or even implied by any of the prior art Ball Throwing Devices, either alone or in any combination thereof.

To attain this, the present invention generally comprises a housing, a plurality of storage tubes secured to said housing which store a plurality of balls, a propelling means connected to the storage tubes, and a corresponding plurality of delivery tubes with an arcuate lumen which are rotatably secured to the housing and connected to the propelling means opposite of the storage tubes.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Multi-Directional Ball Throwing System apparatus and method which has many of the advantages of the Ball Throwing Devices mentioned heretofore and many novel features that result in a new Multi-Directional Ball Throwing System which is not anticipated, rendered obvious, suggested, or even implied by any of the prior art Ball Throwing Devices, either alone or in any combination thereof.

It is another object of the present invention to provide a new Multi-Directional Ball Throwing System which may be easily and efficiently manufactured and marketed.

It is a further object of the present invention to provide a new Multi-Directional Ball Throwing System which is of a durable and reliable construction.

An even further object of the present invention is to provide a new Multi-Directional Ball Throwing System which is susceptible of a low cost of manufacture with regard to both materials and labor, and which accordingly is then susceptible of low prices of sale to the consuming public, thereby making such Multi-Directional Ball Throwing System economically available to the buying public.

Still yet another object of the present invention is to provide a new Multi-Directional Ball Throwing System which provides in the apparatuses and methods of the prior art some of the advantages thereof, while simultaneously overcoming some of the disadvantages normally associated therewith.

Still another object of the present invention is to provide a new Multi-Directional Ball Throwing System for propelling a ball in three selective directions at various velocities without the user discontinuing play.

Yet another object of the present invention is to provide a new Multi-Directional Ball Throwing System which includes a housing, a plurality of storage tubes secured to said housing which store a plurality of balls, a propelling means connected to the storage tubes, and a corresponding plurality of delivery tubes with an arcuate lumen which are rotatably secured to the housing and connected to the propelling means opposite of the storage tubes.

Still yet another object of the present invention is to provide a new Multi-Directional Ball Throwing System that folds into a carrying position for easy transportation.

Even still another object of the present invention is to provide a new Multi-Directional Ball Throwing System that doesn't require to user to discontinue play to reset the throwing position.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
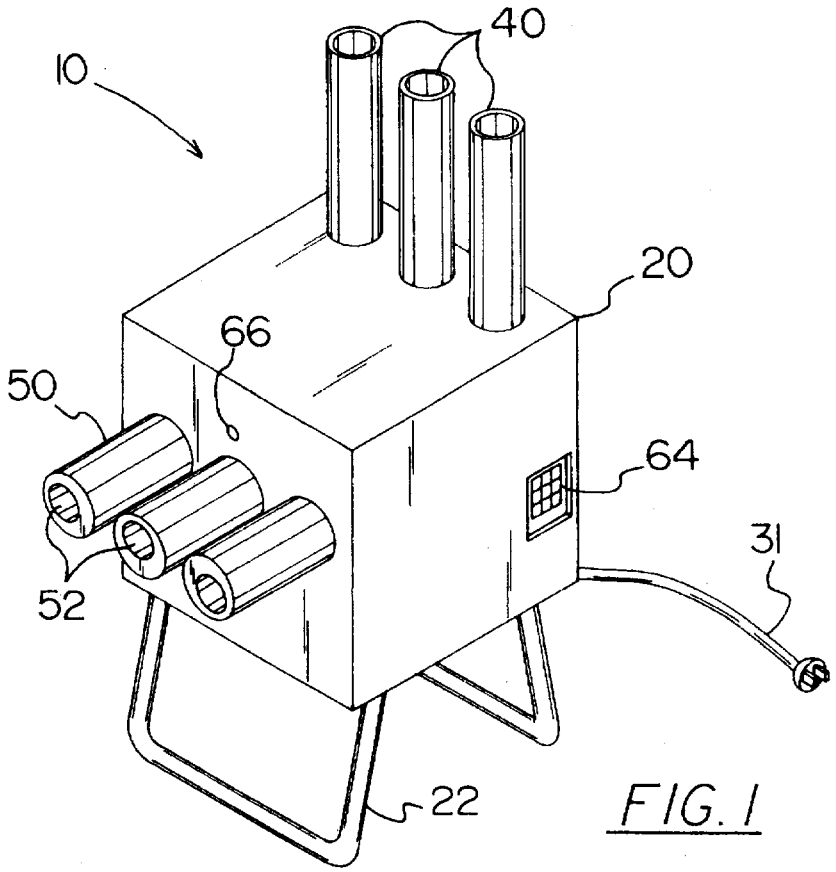
FIG. 1 is an upper side perspective view of a new Multi-Directional Ball Throwing System according to the present invention.

With reference now to the drawings, and in particular to FIGS. 1 through 6 thereof, a new Multi-Directional Ball Throwing System embodying the principles and concepts of the present invention and generally designated by the reference numeral 10 will be described.

More specifically, it will be noted that the Multi-Directional Ball Throwing System 10 comprises a housing 20 having an interior cavity 24, at least one storage tube 40 secured to the housing 20 extending into the interior cavity 24, a propelling means 30 secured within the interior cavity 24 and connected to the storage tube 40 to propel a ball 12 within the storage tube 40 opposite of the storage tube 40, and at least one delivery tube 50 rotatably secured within the housing 20 projecting within the interior cavity 24 and connecting to the propelling means 30 opposite of the storage tube 40, where the delivery tube 50 receives the projected ball 12 from the propelling means 30.

Figure 2:
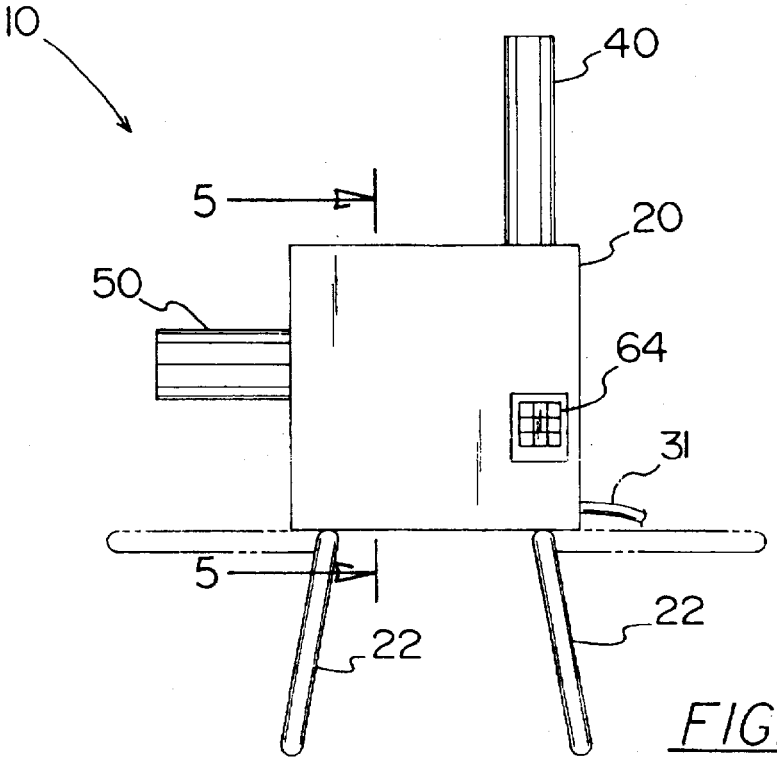
FIG. 2 is a side view of the present invention.
Figure 3:
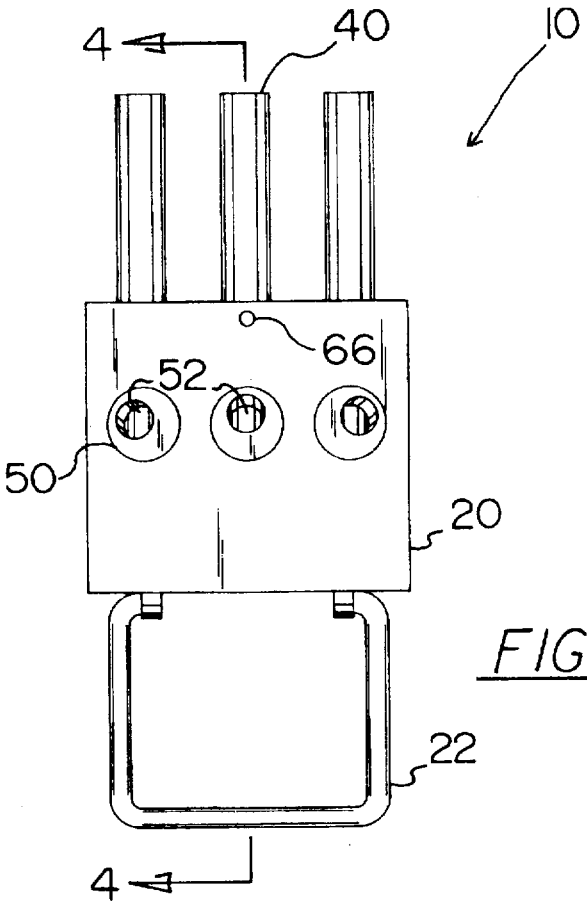
FIG. 3 is a front view of the present invention.
Figure 4:
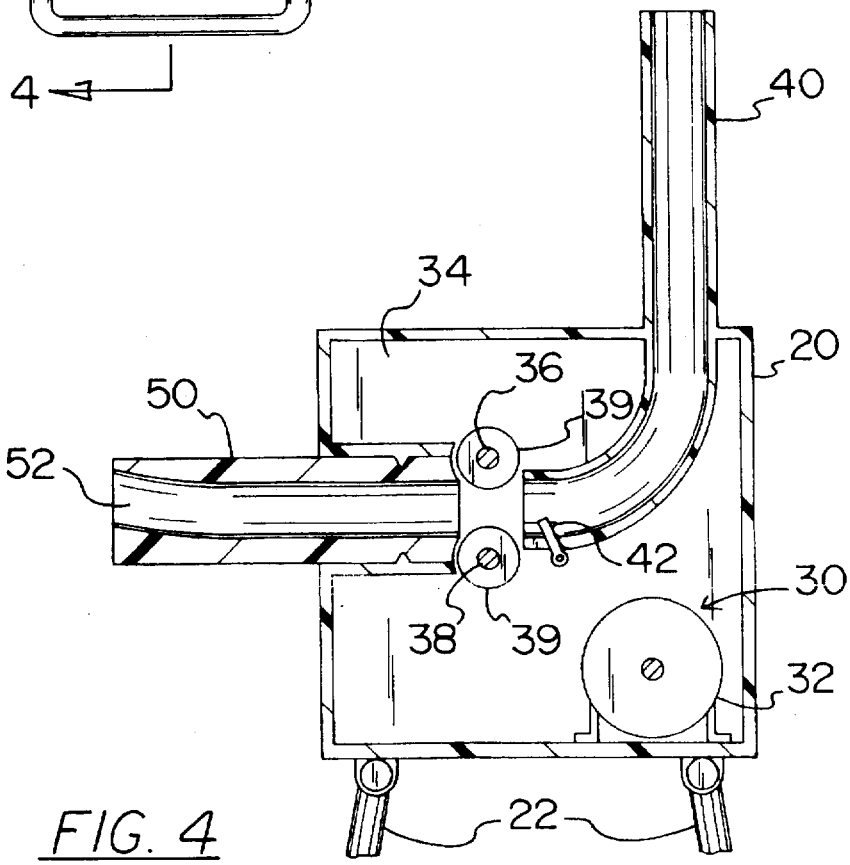
FIG. 4 is a cross sectional view taken along line 4—4 of FIG. 3.

As best illustrated in FIG. 4, it can be shown that the delivery tube 50 has an arcuate lumen 52 from the concentric portion to the end opposite of the propelling means 30. The arcuate lumen 52 directs the propelled ball 12 in a selected direction based upon the rotational position of the delivery tube 50 which is manipulated by the user. The storage tube 40 has a ball stopper 42 electronically controlled by a control panel 64 to allow release of only one ball 12 at a time as shown in FIG. 4 of the drawings. As shown in FIGS. 1 through 3 of the drawings, a pair of U-shaped legs 22 are pivotally secured to the bottom of the housing 20 which extend horizontally to allow easy transportation.

Figure 5:
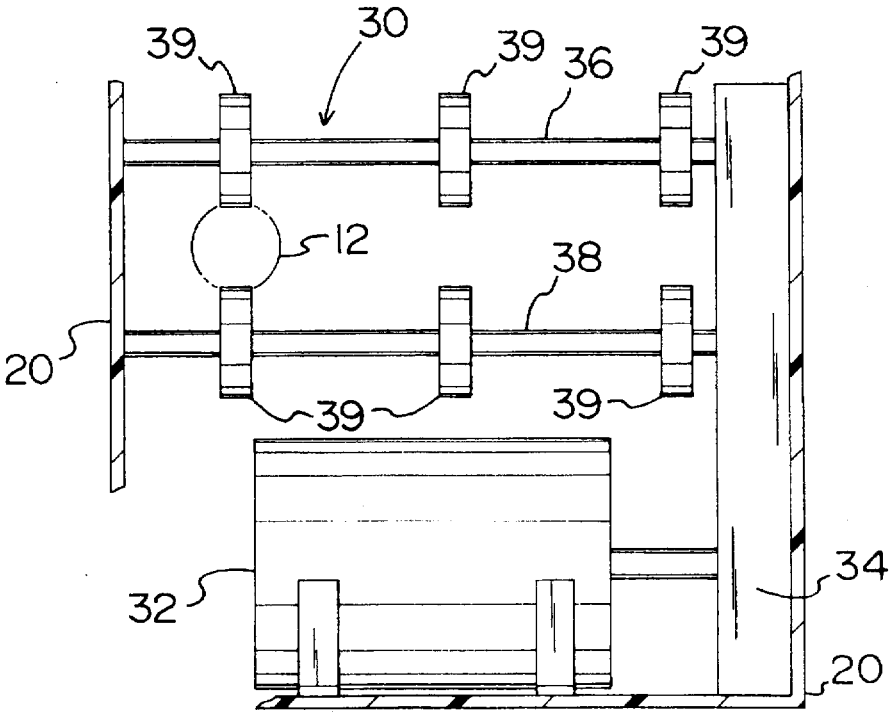
FIG. 5 is a cross sectional view taken along line 5—5 of FIG. 2.
Figure 6:
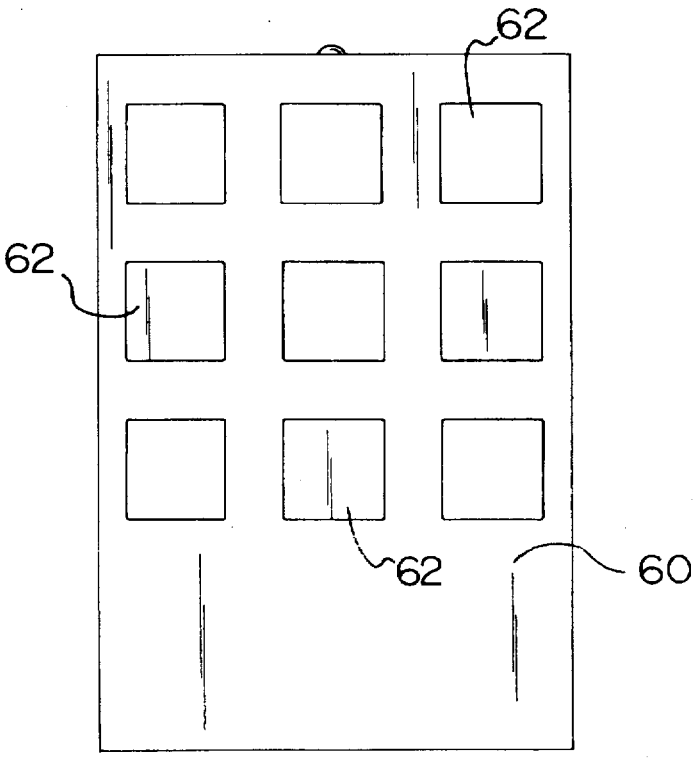
FIG. 6 is a top view of the remote control.

As shown in FIGS. 4 and 5 of the drawings, the propelling means 30 has an electric motor 32 secured within the interior cavity 24. A power cord 31 is electrically coupled to the electric motor 32 thereby providing electricity to the electric motor 32. A transfer gear box 34 is secured within the interior cavity 24 and mechanically connected to the electric motor 32 as best shown in FIG. 5. A first shaft 36 is rotatably secured within the housing 20 and mechanically connected to the transfer gear box 34 to receive the rotational torque from the electric motor 32. A second shaft 38 is rotatably secured within the housing 20 parallel to the first shaft 36 and mechanically connected to the transfer gear box 34 to receive the rotational torque from the electric motor 32 at the same rotational speed or different rotation speed as the first shaft 36 depending upon the desired throw by the by user. A pair of propelling wheels 39 are secured in aposition to one another to the first shaft 36 and second shaft 38 spaced apart to receive the ball 12 from the storage tube 40 mesial the outer surfaces of the propelling wheels 39 in aposition to one another. A control panel 64 is electronically coupled to the electric motor 32 and electrically coupled to the ball stopper 42 to control the velocity and direction of the ball 12. As shown in FIGS. 1 and 3, there are preferably three delivery tubes 50 rotatably secured within the housing 20 which receive the ball 12 from each propelling means 30. A receiver 66 is secured within the housing 20 and electronically coupled to the control panel 64, thereby receiving a signal from a remote control 60 by the user selectively pressing the desired buttons 62.

In use, the user rotates each of the three delivery tubes 50 to the desired position. Thereafter, the user either controls the output through the control panel 64 or through the remote control 60 for what kind of deliveries that the user wishes to receive. The ball stopper 42 of the selected storage tube 40 is rotated allowing the ball 12 to pass by into the propelling means 30. The propelling means 30 propels the ball 12 at the selected velocity and rotation out through the selected delivery tube 50. The ball 12 passes through the arcuate lumen 52 thereby projecting at the angle determined by the arcuate lumen 52 where the delivery tube 50 is rotated to control the direction through the arcuate lumen 52. The control panel 64 can be selected to various velocities, which delivery tube 50 to propel the ball 12 through, or the control panel 64 can be programmed to randomly select among the various options.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A Multi-Directional Ball Throwing System comprising:

a housing having an interior cavity;

at least one storage tube secured to said housing extending into said interior cavity;

a propelling means secured within said interior cavity and connected to said storage tube to propel a ball within said storage tube opposite of said storage tube; and at least two elongate delivery tubes projecting out of the interior cavity of said housing in a substantially parallel relationship to each other said delivery tubes being mounted adjacent to said propelling means in a position for receiving a ball propelled by said propelling means;

wherein each said delivery tube has a substantially cylindrical exterior surface, each said delivery tube having an arcuate lumen therein such that a ball traveling through said arcuate lumen exits the arcuate lumen in a direction skewed from the longitudinal axis of said substantially cylindrical delivery tube, and wherein each said delivery tube is mounted on said housing in a manner permitting rotation of each said delivery tube about the longitudinal axis thereof such that each said delivery tubes may be rotated to substantially simultaneously throw balls in different directions.

2. The multi-directional ball throwing system of claim 1 having at least three delivery tubes rotatably secured within said housing.

3. The multi-directional ball throwing system of claim 1 wherein said storage tube includes a ball stopper electronically controlled to allow release of only one ball at a time into said propelling means.

4. The multi-directional ball throwing system of claim 1 wherein a pair of U-shaped legs are pivotally secured to the bottom of said housing which extend horizontally to allow easy transportation.

5. A multi-directional ball throwing system comprising:

a housing having an interior cavity;

at least one storage tube secured to said housing extending into said interior cavity;

a propelling means secured within said interior cavity and connected to said storage tube to propel a ball within said storage tube opposite of said storage tube; and at least one delivery tube rotatably secured within said housing projecting within said interior cavity and connecting to said propelling means opposite of said storage tube, where said delivery tube receives said projected ball from said propelling means;

wherein said delivery tube has an arcuate lumen from the concentric portion to the end opposite of said propelling means, thereby directing the propelled ball in a selected direction based upon the rotational position of said delivery tube;

wherein said storage tubes include a ball stopper electronically controlled to allow release of only one ball at a time;

wherein a pair of U-shaped legs are pivotally secured to the bottom of said housing which extend horizontally to allow easy transportation; and wherein said propelling means includes:

an electric motor secured within said interior cavity;

a power cord electrically coupled to said electric motor;

a transfer gear box secured within said interior cavity and mechanically connected to said electric motor;

a first shaft rotatably secured within said housing and mechanically connected to said transfer gear box to receive the rotational torque from said electric motor;

a second shaft rotatably secured within said housing parallel to said first shaft and mechanically connected to said transfer gear box to receive the rotational torque from said electric motor; and a pair of propelling wheels secured in aposition to one another to said first shaft and second shaft spaced apart to receive said ball mesial the outer surfaces of said propelling wheels in aposition to one another.

6. The multi-directional ball throwing system of claim 5, wherein a control panel is electronically coupled to said electric motor and said ball stopper to control the velocity and direction of said ball.

7. The multi-directional ball throwing system of claim 6, wherein there are three delivery tubes rotatably secured within said housing.

8. The multi-directional ball throwing system of claim 7, wherein a receiver is secured within said housing and electronically coupled to said control panel thereby receiving a signal from a remote control by the user selectively pressing the desired buttons.

9. A multi-directional ball throwing system comprising:

a housing having an interior cavity;

at least one storage tube secured to said housing extending into said interior cavity;

a propelling means secured within said interior cavity and connected to said storage tube to propel a ball within said storage tube opposite of said storage tube; and at least one delivery tube rotatably secured within said housing projecting within said interior cavity and connecting to said propelling means opposite of said storage tube at one end where said delivery tube receives said projected ball from said propelling means;

wherein said delivery tube has an arcuate lumen from the concentric portion to the end opposite of said propelling means, thereby directing the propelled ball in a selected direction based upon the rotational position of said delivery tube;

wherein each of said storage tubes include a ball stopper electronically controlled to allow release of only one ball at a time; and wherein said propelling means includes: an electric motor secured within said interior cavity;

a transfer gear box secured within said interior cavity and mechanically connected to said electric motor;

a first shaft rotatably secured within said housing and mechanically connected to said transfer gear box to receive the rotational torque from said electric motor;

a second shaft rotatably secured within said housing parallel to said first shaft and mechanically connected to said transfer gear box to receive the rotational torque from said electric motor; and a pair of propelling wheels secured in aposition to one another to said first shaft and second shaft spaced apart to receive said ball between the outer surfaces of said propelling wheels in aposition to one another.

* * * * *